US010591227B2

(12) United States Patent
Lu et al.

(10) Patent No.: US 10,591,227 B2
(45) Date of Patent: Mar. 17, 2020

(54) HEAT EXCHANGER INCLUDING A MIXING AND REDISTRIBUTION HEADER

(71) Applicant: DANFOSS MICRO CHANNEL HEAT EXCHANGER (JIAXING) CO., LTD., Zhejiang (CN)

(72) Inventors: Xiangxun Lu, Zhejiang (CN); Jianlong Jiang, Zhejiang (CN); Jing Yang, Zhejiang (CN); Yubao Liu, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 0 days.

(21) Appl. No.: 15/312,783

(22) PCT Filed: May 28, 2015

(86) PCT No.: PCT/CN2015/080047
§ 371 (c)(1),
(2) Date: Nov. 21, 2016

(87) PCT Pub. No.: WO2015/180661
PCT Pub. Date: Dec. 3, 2015

(65) Prior Publication Data

US 2017/0138675 A1 May 18, 2017

(30) Foreign Application Priority Data

May 28, 2014 (CN) ..... 2014 1 0230981

(51) Int. Cl.
*F28F 9/02* (2006.01)
*F28D 1/053* (2006.01)
(Continued)

(52) U.S. Cl.
CPC ..... *F28F 9/028* (2013.01); *F28D 1/0435* (2013.01); *F28D 1/05366* (2013.01);
(Continued)

(58) Field of Classification Search
CPC ... F28F 9/0273; F28F 9/0278; F28D 1/05391; F25B 2339/0444; F25B 39/028
See application file for complete search history.

(56) References Cited

U.S. PATENT DOCUMENTS

2008/0202153 A1* 8/2008 Watanabe ..... F28D 1/05391 62/498
2009/0120627 A1* 5/2009 Beamer ..... F28D 1/05375 165/174
(Continued)

FOREIGN PATENT DOCUMENTS

CN 101713605 A 5/2010
CN 101821577 A 9/2010
(Continued)

OTHER PUBLICATIONS

Translation of Japanese Patent Publication JPH07159000A entitled Translation-JPH07159000A (Year: 2019).*
(Continued)

*Primary Examiner* — Paul Alvare
(74) *Attorney, Agent, or Firm* — McCormick, Paulding & Huber PLLC

(57) ABSTRACT

A heat exchanger including a mixing and redistribution header (20) at one end of the heat exchanger; multiple heat exchange tubes (30) in communication with the mixing and redistribution header (20). An upper cavity (21) and a lower cavity (22) in communication with each other are disposed in the mixing and redistribution header (20); a fluid entering the heat exchanger first of all flows into a part of the lower cavity (22) of the mixing and redistribution header (20), then
(Continued)

is collected and mixed in the upper cavity (21) of the mixing and redistribution header (20), and is distributed into another part of the lower cavity (22) and flows out through a heat exchange tube (30) in communication with the lower cavity, a cross-sectional area of the upper cavity (21) being equal to or greater than a cross-sectional area of the lower cavity (22).

12 Claims, 18 Drawing Sheets

(51) Int. Cl.
*F28D 1/04* (2006.01)
*F28D 7/00* (2006.01)
*F25B 39/02* (2006.01)

(52) U.S. Cl.
CPC ..... *F28D 7/0066* (2013.01); *F28F 9/0207* (2013.01); *F28F 9/0212* (2013.01); *F28F 9/0243* (2013.01); *F28F 9/0273* (2013.01); *F28F 9/0278* (2013.01); *F25B 39/028* (2013.01); *F25B 2339/0444* (2013.01); *F28D 1/05383* (2013.01); *F28D 1/05391* (2013.01)

(56) References Cited

U.S. PATENT DOCUMENTS

| | | | | |
|---|---|---|---|---|
| 2010/0206535 | A1* | 8/2010 | Munoz | F25B 39/028 165/173 |
| 2011/0240276 | A1 | 10/2011 | Wintersteen et al. | |
| 2013/0292098 | A1* | 11/2013 | Jindou | F28F 13/06 165/143 |
| 2015/0292820 | A1 | 10/2015 | Katoh et al. | |

FOREIGN PATENT DOCUMENTS

| | | | | |
|---|---|---|---|---|
| CN | 201954846 | U | | 8/2011 |
| CN | 102384692 | A | | 3/2012 |
| CN | 102455088 | A | | 5/2012 |
| CN | 101558277 | B | | 11/2012 |
| CN | 202792697 | U | | 3/2013 |
| CN | 103776282 | A | | 5/2014 |
| CN | 103983126 | A | | 8/2014 |
| DE | 43 30 214 | A1 | | 3/1995 |
| EP | 2581696 | A1 | | 4/2013 |
| JP | H07159000 | A | | 6/1995 |
| JP | H07159000 | A | * | 6/1995 |
| JP | 2005127529 | A | | 5/2005 |
| JP | 2006207994 | A | | 8/2006 |
| JP | 2008531976 | A | | 8/2008 |
| JP | 2009198016 | A | | 9/2009 |
| JP | 2010127510 | A | | 6/2010 |
| KR | 10-2012-0044849 | A | | 5/2012 |
| WO | 2008048505 | A2 | | 4/2008 |
| WO | 2013005729 | A1 | | 1/2013 |
| WO | 2013076993 | A1 | | 5/2013 |
| WO | 2014076874 | A1 | | 5/2014 |

OTHER PUBLICATIONS

International Search Report for PCT Serial No. PCT/CN2015/080047 dated Jul. 28, 2015.
Supplementary European Search Report for Serial No. EP 15 79 9574 dated May 9, 2018.
Supplementary Partial European Search Report for Serial No. EP 15 79 9574 dated Jan. 5, 2018.
First Examination Report for Indian Serial No. 201617040074 dated Aug. 5, 2019.

* cited by examiner

HEAT EXCHANGER INCLUDING A MIXING AND REDISTRIBUTION HEADER

CROSS REFERENCE TO RELATED APPLICATION

This application is entitled to the benefit of and incorporates by reference subject matter disclosed in the International Patent Application No. PCT/CN2015/080047 filed on May 28, 2015 and Chinese Patent Application No. 201410230981.9 filed on May 28, 2014.

TECHNICAL FIELD

The present invention relates to the fields of heating, ventilating and air conditioning, motor vehicles, refrigeration and transportation, and in particular relates to a heat exchanger for an evaporator, condenser or water tank, etc.

BACKGROUND

In a heat exchanger in an ordinary household or commercial air conditioning system, as shown in FIG. 1, there are inlet/outlet tubes 1 and 2; headers 3 at two ends are responsible for distributing and collecting a refrigerant; flat tubes 4, with small channels in the interior thereof, are inserted into the headers 3 by means of slots in the headers 3, and are responsible for heat transfer between a refrigerant and air when the refrigerant is circulating. Corrugated fins 5 between the flat tubes are responsible for enhancing the heat exchange effect. When air, driven by a blower, flows past the fins 5 and flat tubes 4, the temperature difference between the air and refrigerant causes heat to be transferred between these two media. In the case of condenser applications, once air is flowing it absorbs heat and flows out; in the case of evaporator applications, once air is flowing it dissipates heat and flows out.

In the case of evaporator and heat pump applications, since these involve the problem of the formation and melting of frost as well as condensed water, the heat exchanger will be positioned so that the headers are arranged in a horizontal direction, while the flat tubes are arranged in a vertical direction, to facilitate the drainage of water. In order to balance the flow rates of refrigerant in each of the flat tubes, a pipeline is added in the header, with different slots being formed on the pipeline according to actual circumstances in order to obtain a better heat exchange effect.

To obtain a better heat exchange area, two heat exchangers may be used (as shown in FIG. 2). In some confined-space applications, such as regenerator applications, and applications in which a motor vehicle air conditioning heat exchanger and a water tank are in parallel, etc., two or more heat exchangers will also be used.

In the case of these conventional heat exchangers, the refrigerant-side temperature will change as refrigerant flows in the flow direction and undergoes heat exchange, while the temperature of inlet air is steady; this will lead to imbalance in the heat exchange efficiency. In the case of through-flow blower applications in particular, such a temperature difference will lead to severe non-uniformity in the temperature of outgoing air, so that the user experiences a significantly reduced level of comfort during use.

To obtain a balanced outgoing air temperature, the design will often employ two heat exchangers. Referring to FIGS. 3 and 4, one of the two heat exchangers is an inlet heat exchanger, while the other is an outlet heat exchanger. Once air has flowed through the two heat exchangers, the air temperatures have been mixed, so a better outgoing air temperature is obtained.

Referring to FIGS. 5-6, in the case of an indoor machine application using twin through-flow blowers 7 in particular: since the temperature difference between top and bottom parts of the air conditioning air outlet of the single heat exchanger (as shown in FIG. 5) is large, the level of comfort will be reduced; therefore, two heat exchangers will often be used (as shown in FIG. 6). Although a more uniform outgoing air temperature can be obtained, the cost of two heat exchangers is high, and the level of processing difficulty is high; moreover, the provision of connecting tubes 8 at the joint between headers will reduce the heat exchange area.

In view of the above, there is definitely a need to provide a novel heat exchanger that is capable of at least partially solving the abovementioned problems.

SUMMARY

The object of the present invention is to solve at least one aspect of the abovementioned problems and defects in the prior art.

In one aspect of the present invention, a heat exchanger is provided, comprising:

a mixing and redistribution header at one end of the heat exchanger;

multiple heat exchange tubes in communication with the mixing and redistribution header;

wherein an upper cavity and a lower cavity in communication with each other are disposed in the mixing and redistribution header; a fluid entering the heat exchanger first of all flows into a part of the lower cavity of the mixing and redistribution header, then is collected and mixed in the upper cavity of the mixing and redistribution header, and is distributed into another part of the lower cavity and flows out through a heat exchange tube in communication with the lower cavity, a cross-sectional area of the upper cavity being equal to or greater than a cross-sectional area of the lower cavity.

Preferably the upper cavity and lower cavity are separated by a partition plate, and the upper cavity is partitioned into at least two sub-cavities, two of the at least two sub-cavities being in communication with each other via a jump tube.

Preferably the upper cavity is partitioned into at least three sub-cavities by separating elements, three of the at least three sub-cavities being in communication with each other via jump tubes.

Preferably the upper cavity is partitioned into three sub-cavities, a first jump tube establishing communication between a left-end sub-cavity and a middle sub-cavity amongst the three sub-cavities has one end located in a middle position of the left-end sub-cavity and another end located in a middle position of the middle sub-cavity;

a second jump tube establishing communication between a right-end sub-cavity and a middle sub-cavity amongst the three sub-cavities has one end located in a middle position of the right-end sub-cavity and another end located in a middle position of the middle sub-cavity, wherein the first jump tube and second jump tube are connected to the middle sub-cavity in nearby positions, or in the same position.

Preferably, wall surfaces between the upper cavity and lower cavity are in communication via holes and/or slots, the lower cavity being partitioned into at least three sub-cavities.

Preferably, the upper cavity and lower cavity are both partitioned into three sub-cavities, with the sub-cavities of the upper cavity being in corresponding communication with the sub-cavities of the lower cavity.

Preferably, a middle section on a wall surface between the upper cavity and lower cavity is in corresponding communication with an inlet cavity of the heat exchanger, two end sections thereof are in corresponding communication with outlet cavities of the heat exchanger respectively, and the wall surface at the two end sections is provided with holes or slots of a size smaller than those in the wall surface at the middle section.

Preferably, the sums of the cross-sectional areas of the holes and/or slots provided in a left end section of the two end sections, the middle section and a right end section of the two end sections are S1, S2 and S3 respectively, the lengths of these in a direction perpendicular to the longitudinal direction of the flat tubes are set to be L1, L2 and L3 respectively, and at least one of the following conditions is satisfied:

$$L2/((L1+L3)/2)=0.8\text{-}1.2,$$

$$L1/L3=0.8\text{-}1.2;$$

S2 is 1-2 times as large as S1 or S3;

$$(S1/S3)/(L1/L3)=0.9\text{–}1.1.$$

Preferably, the heat exchanger also comprises an inlet header and an outlet header, or an inlet/outlet header, which is/are in communication with the mixing and redistribution header via heat exchange tubes.

Preferably, a distributing tube is disposed in an inlet cavity in the inlet header or inlet/outlet header, and a collecting tube is disposed in an outlet cavity in the outlet header or inlet/outlet header.

Preferably, the upper cavity and lower cavity are a single-piece structure or a combined structure, wherein the ratio of the numbers of the heat exchange tubes connected to the inlet cavity and outlet cavity is in the range 0.8-1.2, and the heat exchange tubes are flat tubes.

In another aspect of the present invention, a heat exchanger is provided, comprising:

a mixing and redistribution header at one end of the heat exchanger;

multiple heat exchange tubes in communication with the mixing and redistribution header;

wherein a collecting/distributing tube is inserted into the mixing and redistribution header, a part of a cavity of the inserted collecting/distributing tube causes fluid from an inlet cavity of the heat exchanger to enter same, while the remaining part of the cavity of the inserted collecting/distributing tube collects and mixes the fluid, and distributes it into a cavity of the mixing and redistribution header, wherein the cross-sectional area of the cavity of the inserted collecting/distributing tube is equal to or larger than the cross-sectional area of the remaining cavity (besides the cavity of the collecting/distributing tube) in the mixing and redistribution header.

Preferably, the mixing and redistribution header is divided into at least two cavities; in one of these cavities, a part of the inserted collecting/distributing tube collects fluid entering the mixing and redistribution header from the inlet cavity, and another part of the inserted collecting/distributing tube distributes fluid into another of the at least two cavities.

Preferably, the mixing and redistribution header is divided into three cavities, a middle cavity amongst the three cavities being in communication with the inlet cavity of the heat exchanger, and two end cavities amongst the three cavities being in communication with an outlet cavity of the heat exchanger.

Preferably, the inserted collecting/distributing tube is two collecting/distributing tubes arranged side by side, the two collecting/distributing tubes both being provided with holes or slots in the middle cavity of the mixing and redistribution header; one of the two collecting/distributing tubes is provided with holes or slots in a left-end cavity of the mixing and redistribution header, while the other is provided with holes or slots in a right-end cavity of the mixing and redistribution header.

Preferably, the inserted collecting/distributing tube is bent or bent in a middle section of the collecting/distributing tube so as to be located outside the mixing and redistribution header and thereby have an increased flow path.

Preferably, the diameter of the inserted collecting/distributing tube is reduced in the middle cavity or at a bending point.

BRIEF DESCRIPTION OF THE DRAWINGS

These and/or other aspects and advantages of the present invention will be made clear and easy to understand by the following description of preferred embodiments in conjunction with the accompanying views, wherein.

DETAILED DESCRIPTION

The technical solution of the present invention is explained in further detail below by means of embodiments in conjunction with the accompanying views 7-17. In this description, identical or similar view labels indicate identical or similar components. The following explanation of embodiments of the present invention with reference to the accompanying views is intended to explain the overall inventive concept of the present invention, and should not be interpreted as limiting the present invention.

Figure 7:
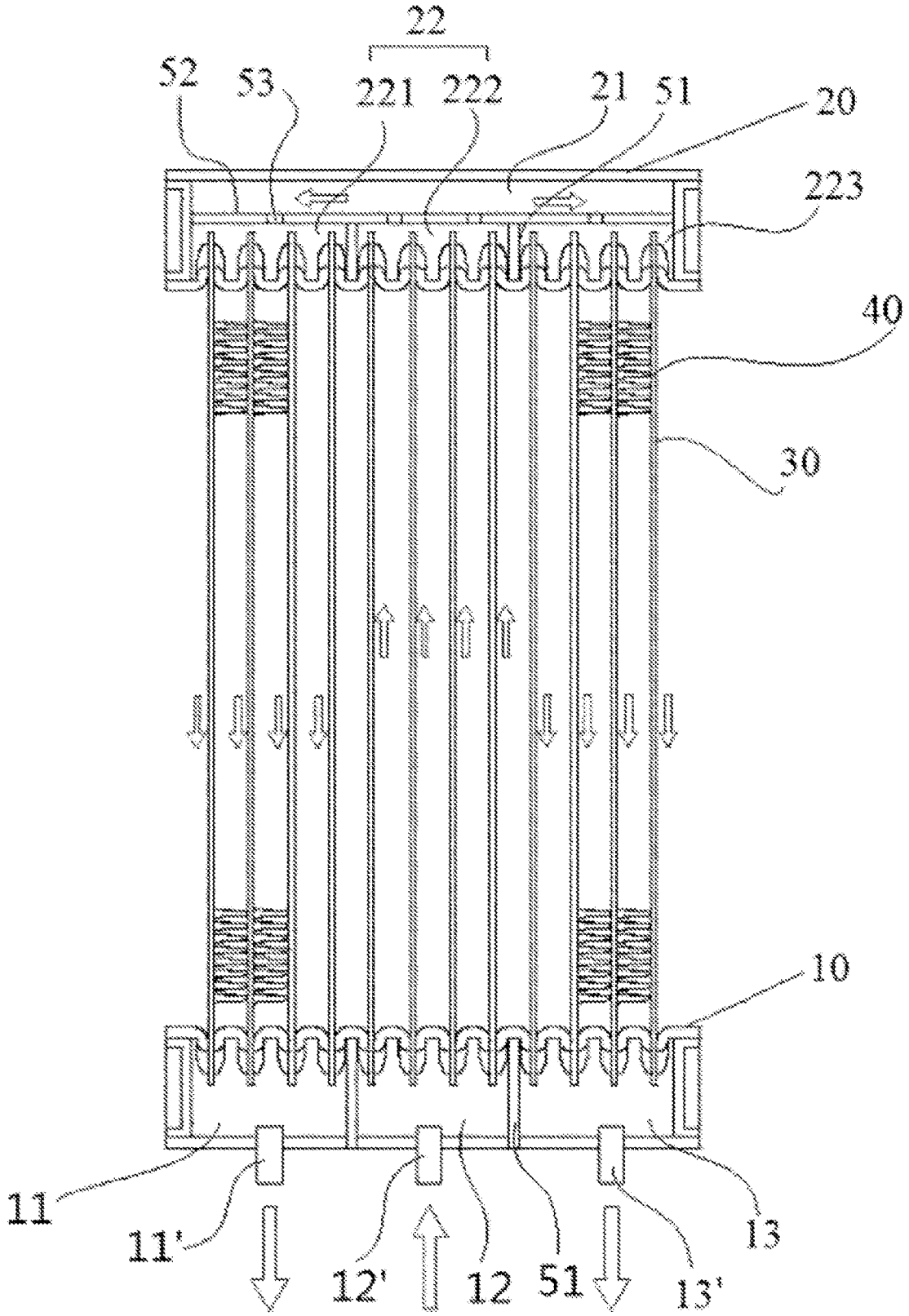
FIG. 7 is a view of a heat exchanger according to an embodiment of the present invention.

Specific reference is made to FIG. 7, which shows a heat exchanger according to an embodiment of the present invention. The heat exchanger comprises a mixing and redistribution header 20 at one end of the heat exchanger, and multiple heat exchange tubes 30 in communication with the mixing and redistribution header 20. In this embodiment, the heat exchanger shown in FIG. 7 also comprises an inlet/outlet header 10 and fins 40. It can be understood that the inlet/outlet header 10 may be designed to be a single piece or separated, i.e. two independent components having separate inlet and outlet cavities.

The inlet/outlet header 10 is disposed at a bottom end of the heat exchanger, the mixing and redistribution header 20 is disposed at a top end of the heat exchanger, and the multiple heat exchanger tubes 30 (such as flat tubes) are disposed between the inlet/outlet header 10 and the mixing and redistribution header 20. In this embodiment, an upper cavity and a lower cavity in communication with each other are disposed in the mixing and redistribution header 20; a fluid entering the heat exchanger first of all flows into a part of the lower cavity of the mixing and redistribution header 20, then is collected and mixed in the upper cavity of the mixing and redistribution header 20, and is distributed into another part of the lower cavity and flows out through a heat exchange tube in communication with the lower cavity, a cross-sectional area of the upper cavity being equal to or greater than a cross-sectional area of the lower cavity.

As the figure shows, the mixing and redistribution header 20 takes the form of two cavities; for example, a partition plate 52 is provided in the longitudinal direction of the mixing and redistribution header 20 (i.e. the left-right direction in the plane of the paper in FIG. 7), such that the partition plate 52 divides a cavity of the mixing and redistribution header 20 into an upper cavity 21 and a lower cavity 22 which are in communication with each other. The upper cavity 21 and lower cavity 22 may have a single-piece structure or a combined structure.

Figure 8:
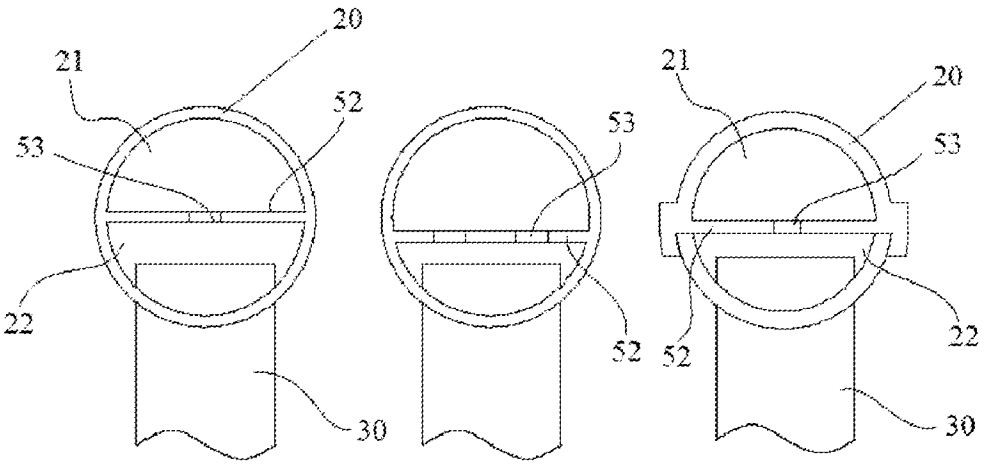
FIG. 8 shows partial enlarged views of three different examples of the way in which the mixing and redistribution header of the heat exchanger shown in FIG. 7 is assembled.

Specifically referring to FIG. 8, the first and second views (from left to right) both show forms in which the upper cavity 21 and lower cavity 22 have a single-piece structure, the difference therebetween being that: in the first view, the upper cavity 21 and lower cavity 22 are in communication via one hole 53, whereas in the second view, the upper cavity 21 and lower cavity 22 are in communication via two holes 53. The third view (from left to right) shows a form in which the upper cavity 21 and lower cavity 22 have a combined structure, the upper cavity 21 and lower cavity 22 being in communication via one hole 53.

Figure 9:
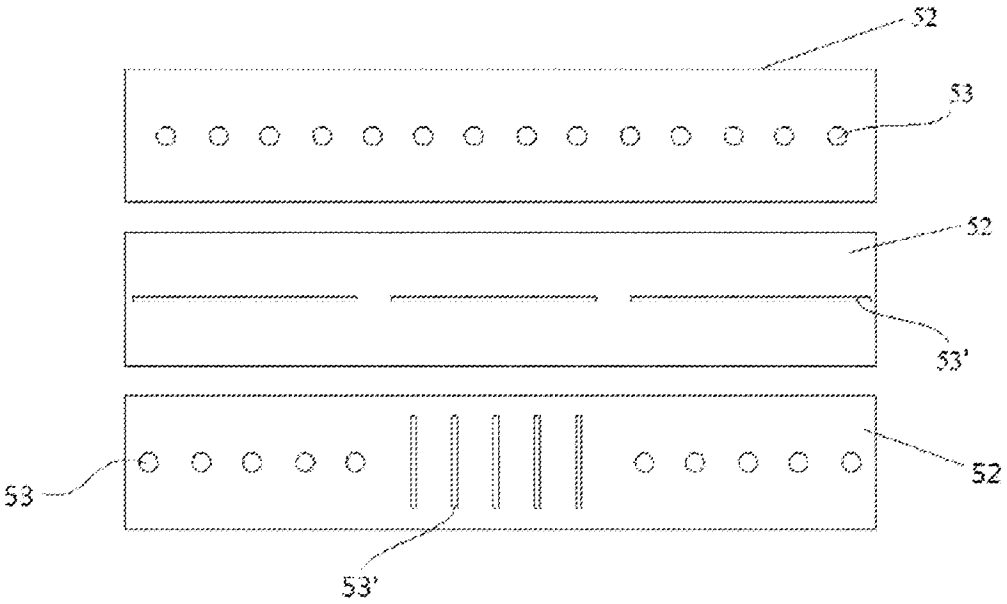
FIG. 9 shows views of three different examples of the way in which the holes and slots are arranged in the mixing and redistribution header shown in FIG. 8.

In other words, a wall surface between the upper cavity 21 and lower cavity 22 may be provided with multiple holes and/or slots to achieve communication, but the specific manner is not limited to the specific form shown in FIG. 9. Referring to FIG. 9, the manner in which communication is achieved between the upper cavity 21 and lower cavity 22 is not limited to the example shown in FIG. 9. A person skilled in the art could provide different forms and/or different numbers of holes and/or slots as required to achieve communication between the two cavities. Thus, the upper cavity 21 realizes the function of collecting and mixing refrigerant from the lower cavity 22. FIG. 9 shows three examples of the manner of arrangement of slots and/or holes in the partition plate 52. In the first view (from top to bottom) in FIG. 9, a row of holes 53 is provided at intervals in the partition plate 52; in the second view, a row of multiple slots 53' (the view shows 3 slots), extending in a direction (the left-right direction in the plane of the paper in FIG. 9) that is parallel to the length direction of the partition plate 52, is provided in the partition plate 52; in the third view, a combination of holes 53 and slots 53' is provided in the partition plate 52, i.e. multiple holes 53 in the form of a row are provided at left and right ends of the partition plate 52, and multiple slots 53' (the view shows 5 slots), extending in the width direction (the up-down direction in the plane of the paper in FIG. 9) of the partition plate 52, are provided in a middle position.

Figure 10:
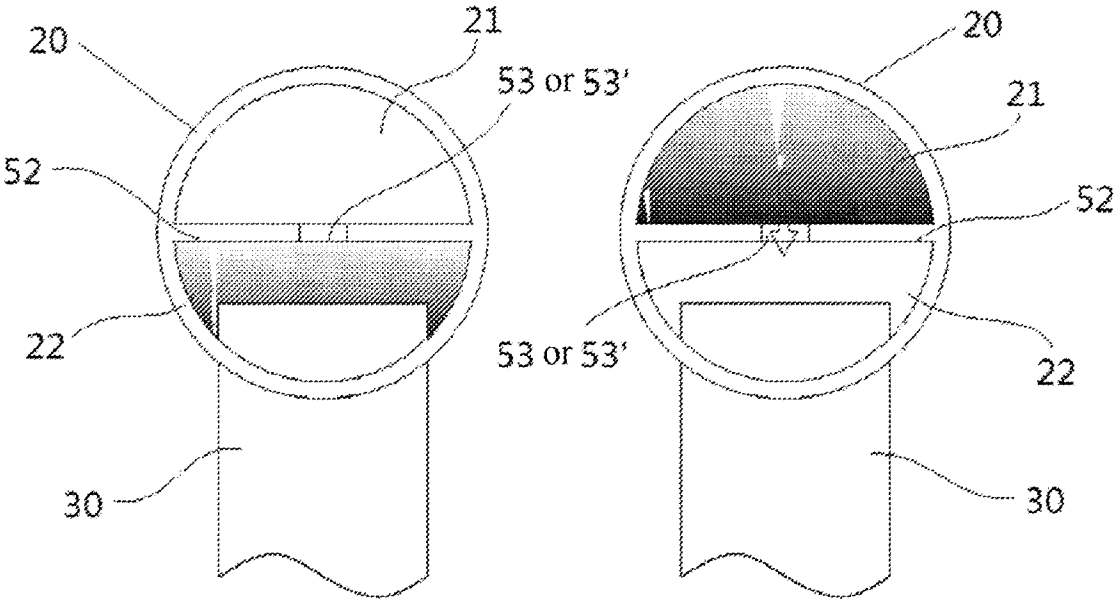
FIG. 10 shows views of the gas/liquid distribution for different cross section ratios of the upper cavity and lower cavity of the mixing and redistribution header of the heat exchanger shown in FIG. 7.

In the prior art, the refrigerant will experience gas/liquid separation at the outlet of the flat tube; this is unfavorable for distribution. To ensure that such gas/liquid separation no longer occurs, in the present invention, the cross-sectional area of the upper cavity 21 is designed to be equal to or greater than the cross-sectional area of the lower cavity 22 (as shown in FIG. 10). This is because, once refrigerant in two phase states has entered a large flow area from a small flow area, the flow speed thereof will fall rapidly, separation of the two phases (gas and liquid) readily occurs, and due to the action of gravity, there will be more liquid in a lower part of a cavity and more gas in an upper part thereof. If the lower cavity is too large, then even if refrigerant is ejected at high speed from distribution holes/slots of the upper cavity, gas/liquid separation will still readily occur because the space in the lower cavity is large (gas/liquid separation readily occurs even if a uniformly mixed two-phase refrigerant is ejected at high speed), and if too much liquid collects in the lower cavity, this will also result in uneven distribution.

If the lower cavity is too small, then even if gas/liquid separation has occurred inside the upper cavity, liquid will be located at the bottom of the upper cavity due to the action of gravity; injection holes/slots are distributed at the bottom, and if high-speed injection is begun in the vicinity thereof, liquid refrigerant will be scattered again, and a very good mixing effect will occur; such a distribution effect will also be very good.

In the example shown in FIG. 7, the inlet/outlet header 10 is partitioned, by separating elements 51 disposed in a direction (i.e. the up-down direction in the plane of the paper in FIG. 7) perpendicular to the longitudinal direction of the inlet/outlet header 10, into three cavities arranged side by side, namely outlet cavities 11 and 13 and an inlet cavity 12. The outlet cavity 11 and outlet cavity 13 are located at two ends of the inlet/outlet header 10 respectively, and are connected to outlet tubes 11' and 13' respectively. The inlet cavity 12 is located between the outlet cavity 11 and the outlet cavity 13, and is connected to an inlet tube 12'.

Referring to FIGS. 7-8, as shown by the arrows therein, after entering the inlet cavity 12 from the inlet tube 12', a fluid such as a refrigerant (not shown) flows to the mixing and redistribution header 20 through flat tubes 30 connected to the inlet cavity, and after being mixed in the header, the refrigerant is distributed to two ends of the mixing and redistribution header 20, then respectively flows into the outlet cavities 11 and 13 of the inlet/outlet header 10 through flat tubes 30 connected to the two ends, and finally flows out of the heat exchanger through the outlet tubes 11' and 13'.

Figure 1:
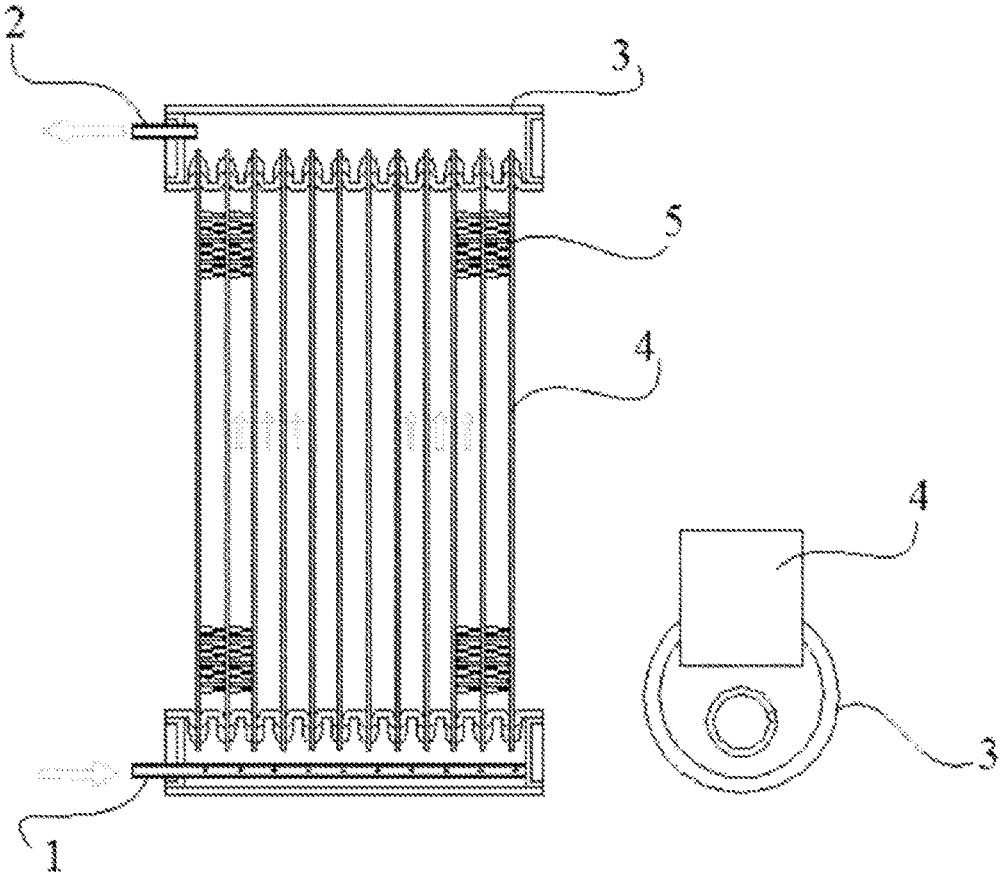
FIG. 1 is a view of a heat exchanger according to the prior art, and a partial enlarged view of the joint between a flat tube and a header.
Figure 2:
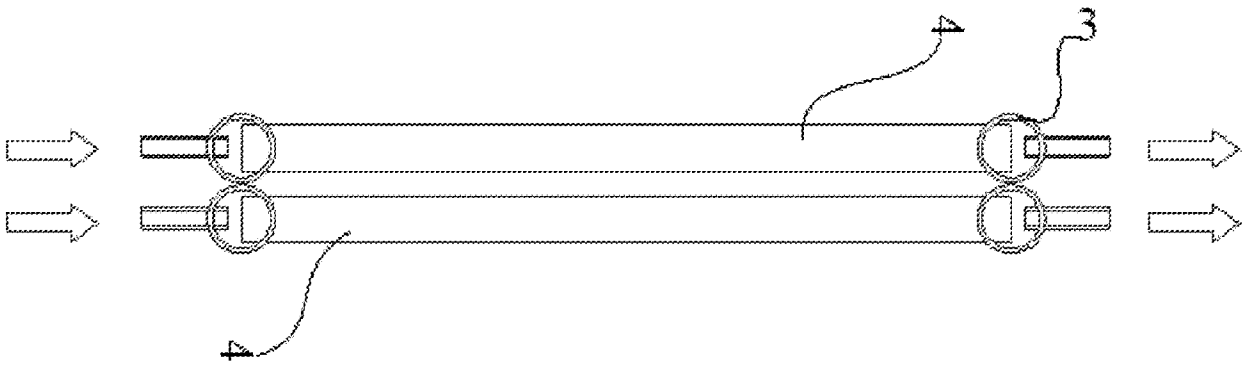
FIG. 2 is a sectional view of two heat exchangers according to the prior art.
Figure 3:
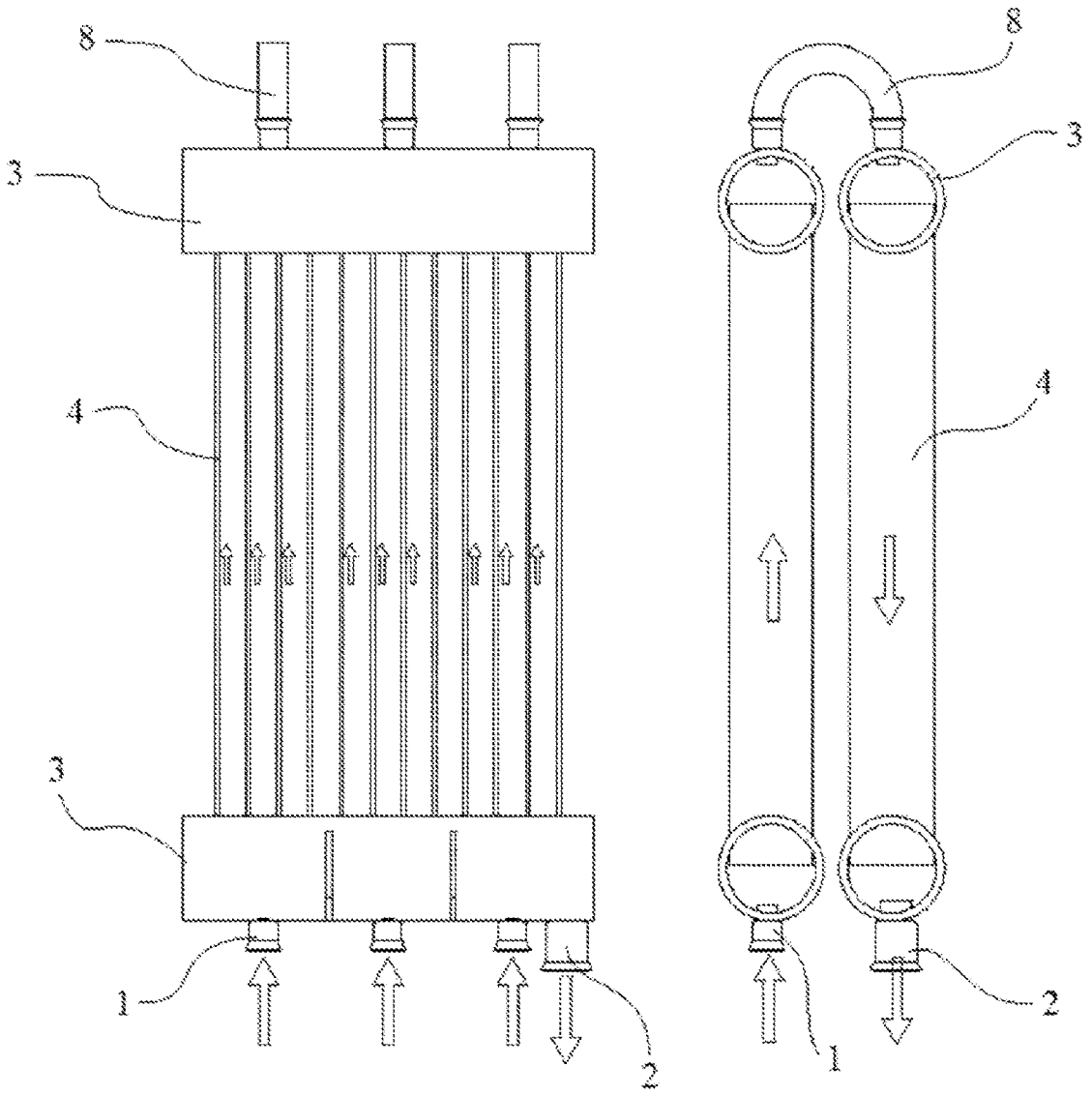
FIG. 3 is a view of another example of two heat exchangers according to the prior art.
Figure 4:
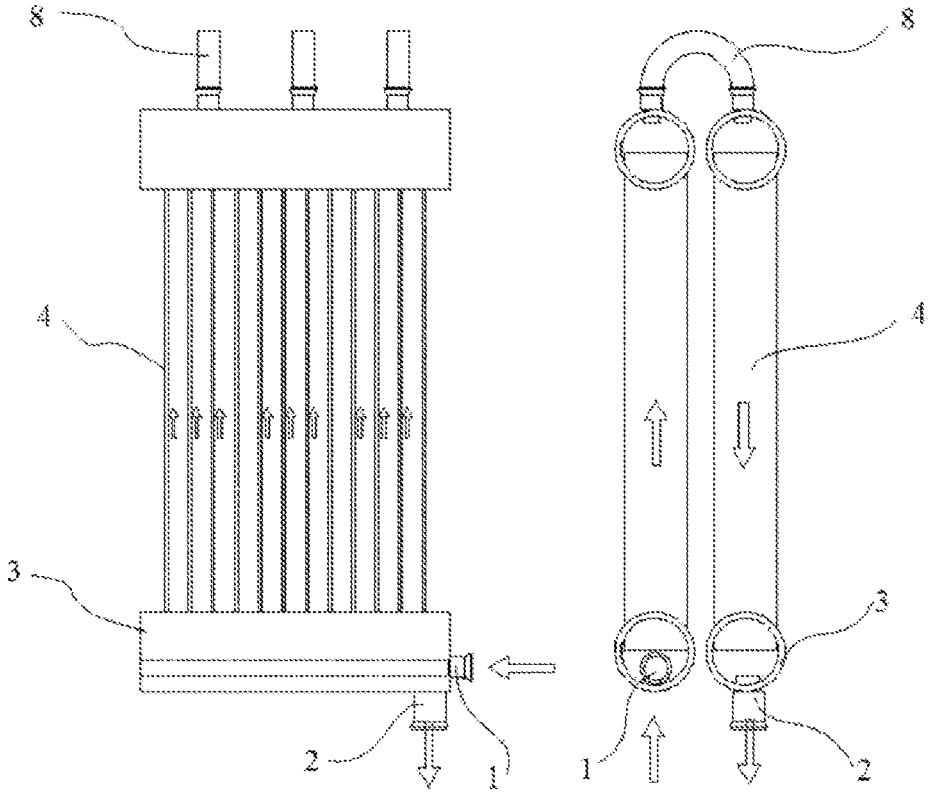
FIG. 4 is a view of another example of two heat exchangers according to the prior art.
Figure 5:
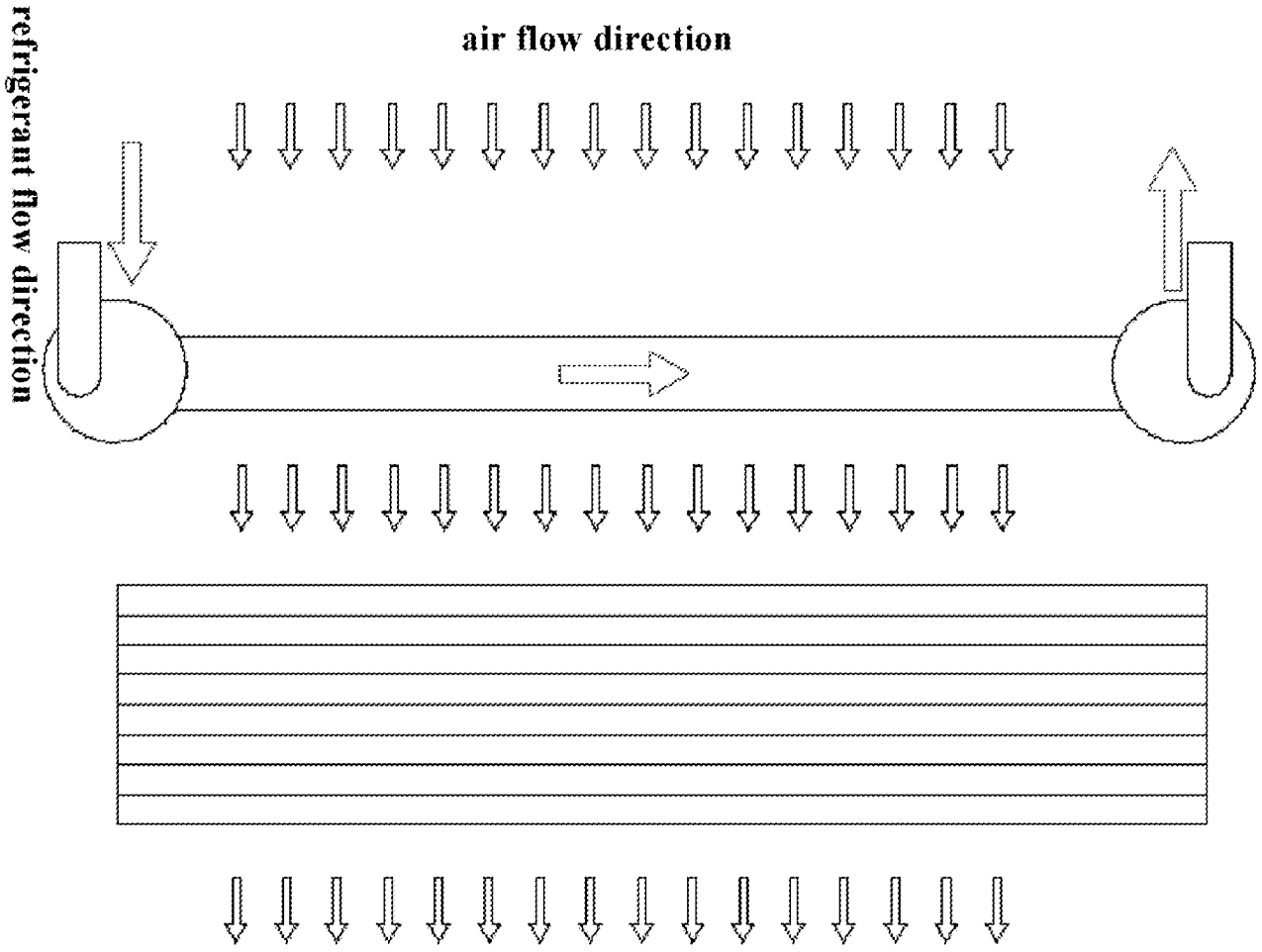
FIG. 5 is a view of a single heat exchanger using twin through-flow blowers in the prior art.
Figure 6:
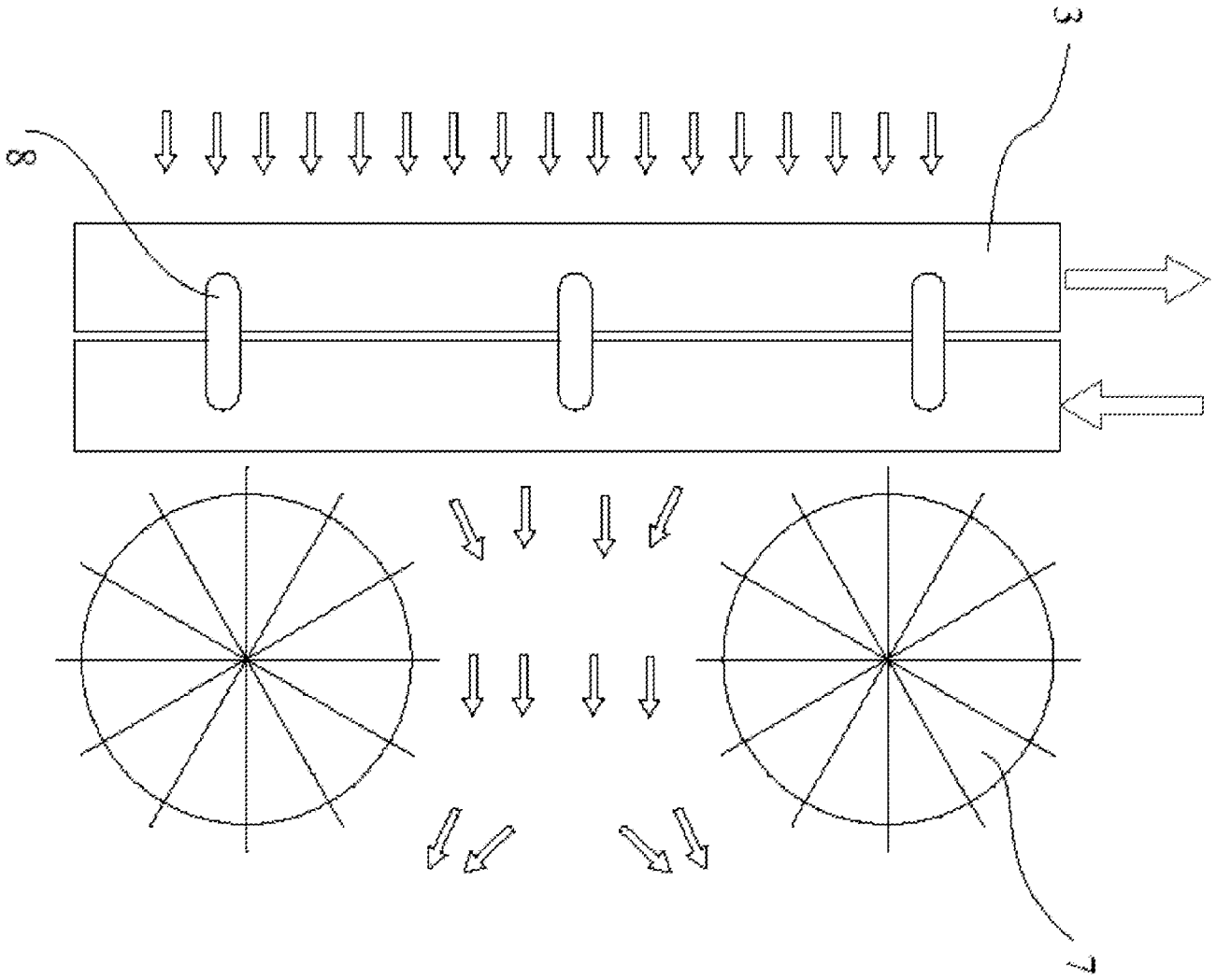
FIG. 6 is a top view of two heat exchangers using twin through-flow blowers in the prior art.

In this embodiment, the number of flat tubes connected to the inlet cavity 12 is set to be A1, the number of flat tubes connected to the outlet cavity 11 is set to be A2, and the number of flat tubes connected to the outlet cavity 13 is set to be A3. The numbers of flat tubes 30 connected to the inlet/outlet cavities 11-13 in the heat exchanger are generally set such that: the ratio of the numbers of flat tubes connected to any two cavities (i.e. the ratio of any two of A1, A2 and A3) is in the range 0.8-1.2, in order to ensure the uniformity of outgoing air. Thus, in the blower form shown in FIG. 6, the entire heat exchanger is divided in the middle, wherein each half has an inlet section flat tube and an outlet section flat tube, and the flow directions are one up, one down; after mixing by the blower, a very good uniform temperature can be obtained in the height direction of the air outlet.

In order to achieve better uniformity of outgoing air, it is necessary for the refrigerant in the tubes of the entire heat exchanger to be uniformly distributed, and for the heat exchanger surface temperature to be distributed in a regular pattern. A conventional solution in the prior art is to: make the flow speed of refrigerant higher in a cavity section entering the flat tubes, but artificially increase flow resistance in a cavity section at the flat tube outlets, such that the flow resistance affecting distribution can lower the specific weight, so as to obtain a better distribution effect.

However, in comparison, in the heat exchanger shown in FIG. 7, since refrigerant enters the mixing and redistribution header 20 in the middle, it must be distributed again into the flat tube sections on two sides of the heat exchanger. Therefore, in the present invention, the uniform distribution of refrigerant in the mixing and redistribution header 20 becomes critical.

Looking back at FIG. 7 again, in the lower cavity 22, separating elements 51 are disposed in a direction (i.e. the up-down direction in the plane of the paper) perpendicular to the longitudinal direction of the mixing and redistribution header 20, and the lower cavity 22 is partitioned into three sub-cavities, namely a first sub-cavity 221, a second sub-cavity 222 and a third sub-cavity 223. The second sub-cavity 222 is in communication with a middle section of the upper cavity 21, and in communication with the inlet cavity 12 by means of flat tubes. The first sub-cavity 221 is in communication with a left-end cavity section of the upper cavity 21, and in communication with the outlet cavity 11 by means of flat tubes. The third sub-cavity 223 is in communication with a right-end cavity section of the upper cavity 21, and in communication with the outlet cavity 13 by means of flat tubes.

Thus, refrigerant from the inlet cavity 12 flows to the second sub-cavity 222, then flows into the upper cavity 21 through holes 53 and/or slots 53' (not shown), then flows to two ends of the upper cavity 21, and is distributed into the first sub-cavity 221 and third sub-cavity 223, again through holes 53 and/or slots 53', then flows to the outlet cavities 11 and 13 through flat tubes 30, and finally flows out of the heat exchanger.

The following explanation shall focus on the method of the present invention for improving the uniform distribution of refrigerant that is distributed, in a middle section of the mixing and redistribution header 20, to two ends.

Figure 11:
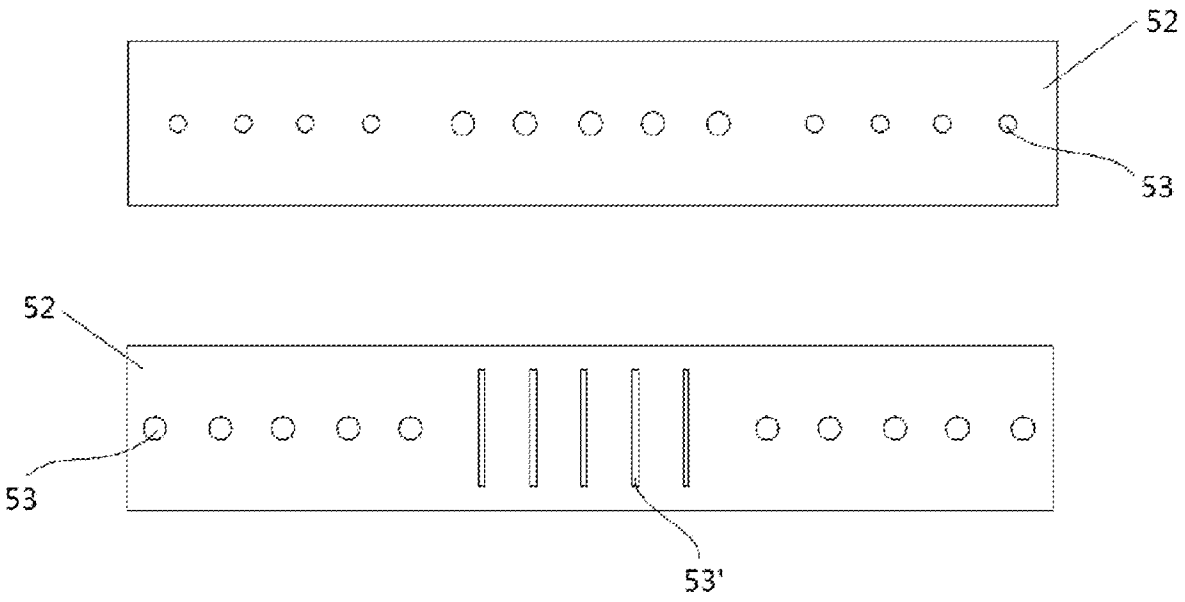
FIG. 11 shows views of the distribution of holes and/or slots in the partition plate in the mixing and redistribution header of the heat exchanger shown in FIG. 7.

In order to achieve uniform distribution of the refrigerant that is distributed, in the middle section of the mixing and redistribution header 20, to the two ends, holes 53 or slots 53' smaller than those in the wall surface of the partition plate 52 in the middle section may be provided in the wall surface of the partition plate 52 in two end sections of the upper cavity 21 (as shown in FIG. 11). Such an arrangement can cause the refrigerant to encounter greater resistance when flowing to the lower cavity 22, and can balance the pressure drop in the upper cavity, thereby reducing non-uniformity of refrigerant flow at the two sides caused by non-uniformity of the pressure drop in the upper cavity.

To ensure uniform distribution of refrigerant and uniform outgoing air temperature, the present invention employs an arrangement in which the sums of the cross-sectional areas of the holes and/or slots in a left end section of the two end sections, the middle section and a right end section of the two end sections are S1, S2 and S3 respectively, the lengths of these three cavity sections in a direction perpendicular to the longitudinal direction of the flat tubes 30 are L1, L2 and L3 respectively, and the arrangement within the mixing and redistribution header must satisfy at least one of the following conditions:

$L2/((L1+L3)/2)=0.8\text{-}1.2$, $L1/L3=0.8\text{-}1.2$; S2 is 1-2 times as large as S1 or S3; $(S1/S3)/(L1/L3)=0.9\text{-}1.1$.

Of course, ideally, all of the ratios in the equations above are 1. The number of flat tubes which can be accommodated within the length of the header is not necessarily a multiple of three, and furthermore, in certain applications, the blower might not be on the center line of the heat exchanger; therefore, it is also feasible for the ratios to be set at smaller fluctuating values.

Figure 12:
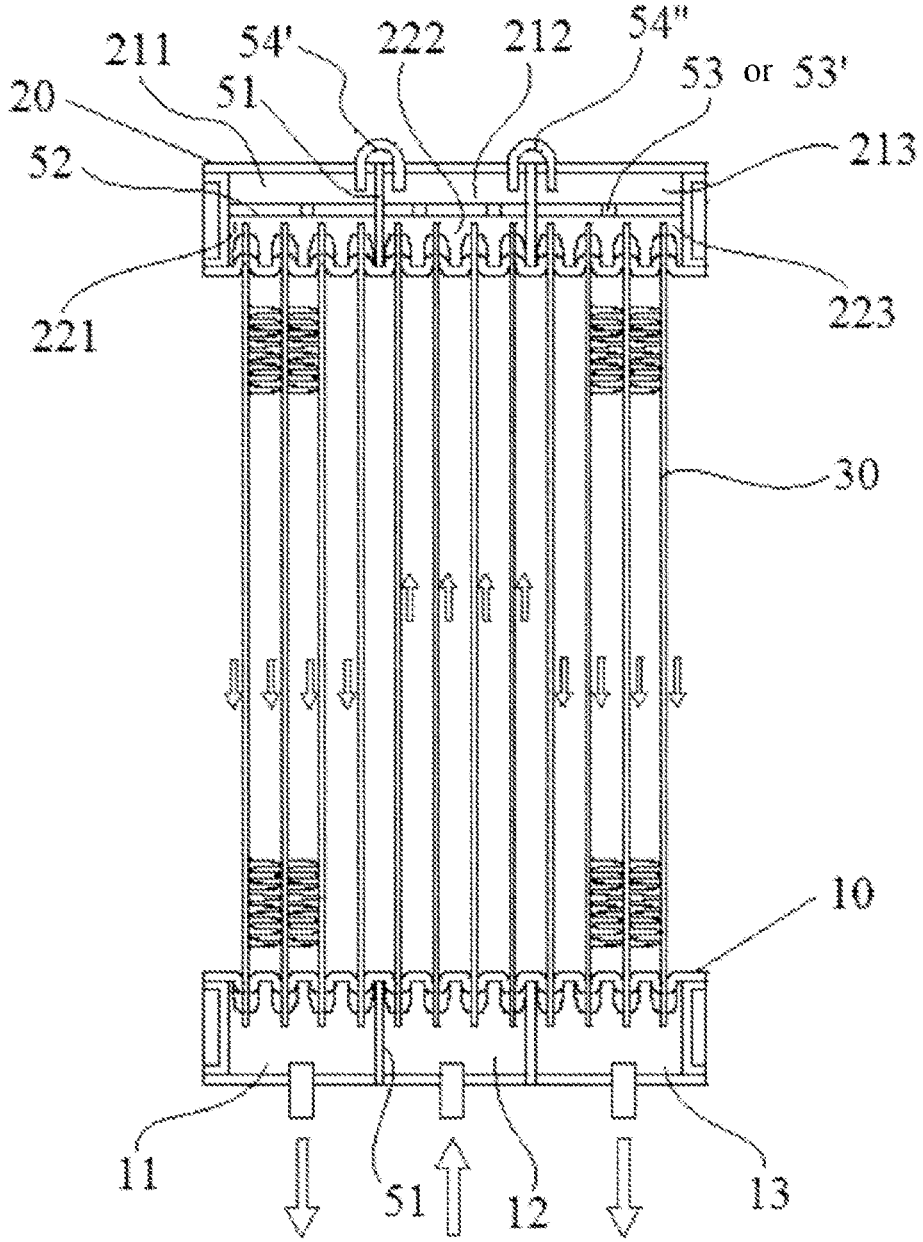
FIG. 12 is a view of a heat exchanger according to another embodiment of the present invention.

Reference is made to FIG. 12, which shows a heat exchanger according to another embodiment of the present invention. This heat exchanger is a variation of the heat exchanger shown in FIG. 7. Thus the structure and principles of this heat exchanger are substantially the same as the structure and principles of the heat exchanger shown in FIG. 7, the difference being that the design of the mixing and redistribution header thereof is different. The differences are described in detail below; identical features will not be repeated here.

In this embodiment, not only are an upper cavity and a lower cavity employed in the mixing and redistribution header, the upper cavity and lower cavity thereof are blocked by separating elements 51. The upper cavity 21 is also partitioned into three sub-cavities, namely a first sub-cavity 211, a second sub-cavity 212 and a third sub-cavity 213, by separating elements 51 disposed in the up-down direction in the plane of the paper. These three cavities are also in communication with three sub-cavities of the lower cavity respectively by means of holes 53 and/or slots 53', i.e. the first sub-cavity 211 in the upper cavity is in communication with a first sub-cavity 221 in the lower cavity, the second sub-cavity 212 in the upper cavity is in communication with a second sub-cavity 222 in the lower cavity, and the third sub-cavity 213 in the upper cavity is in communication with a third sub-cavity 223 in the lower cavity. At this time, the second sub-cavity 212 is in communication with the first and third sub-cavities 211 and 213 via jump tubes 54' and 54" respectively, so that the amounts of refrigerant distributed to the two ends can be made more uniform by increasing the flow resistance in the flow paths of the refrigerant distributed to the left and right ends. Specifically, the second sub-cavity 212 is a middle section of the upper cavity, and the first and third sub-cavities 211 and 213 are a left end section and a right end section of the upper cavity 21 respectively.

Figure 13A:
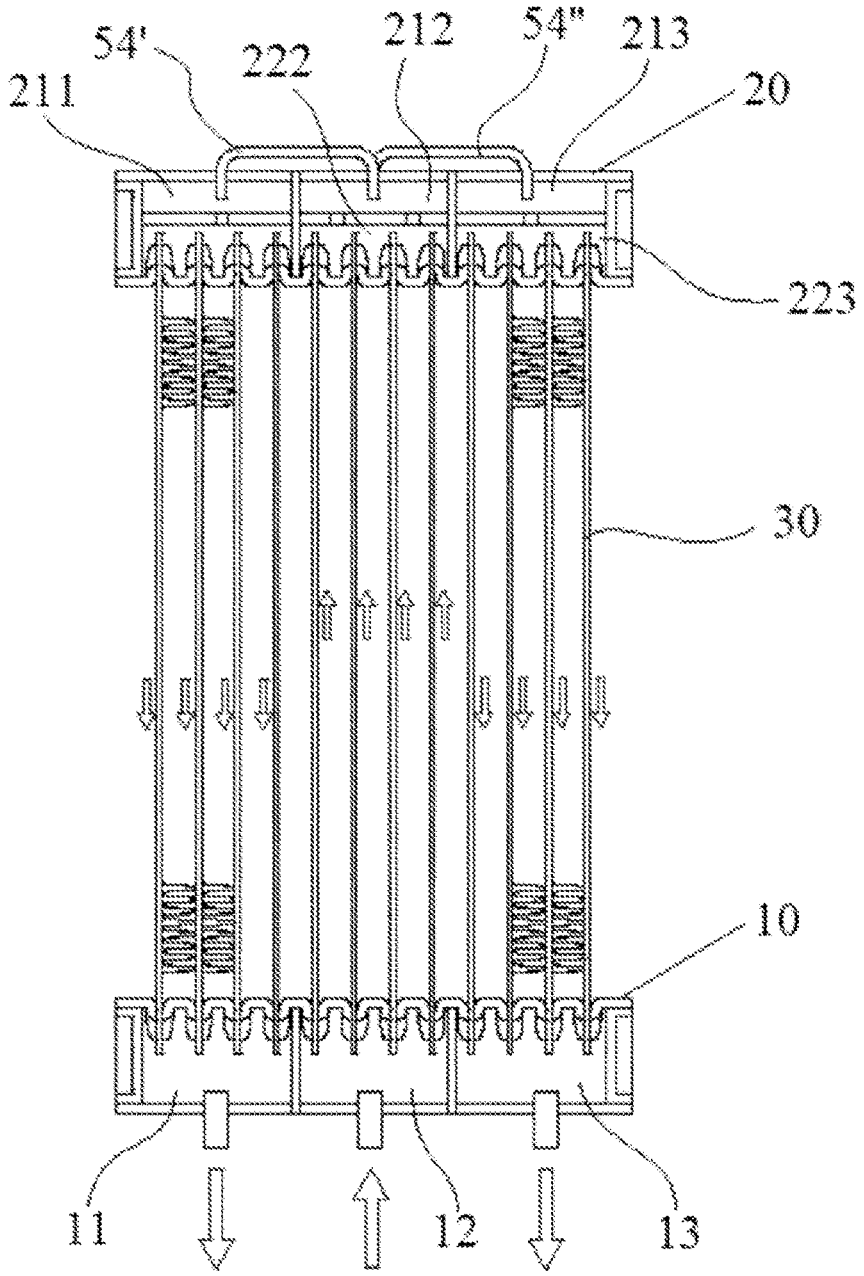
FIG. 13*a* is a view of the heat exchanger shown in FIG. 12 with jump tubes disposed in middle positions.
Figure 13B:
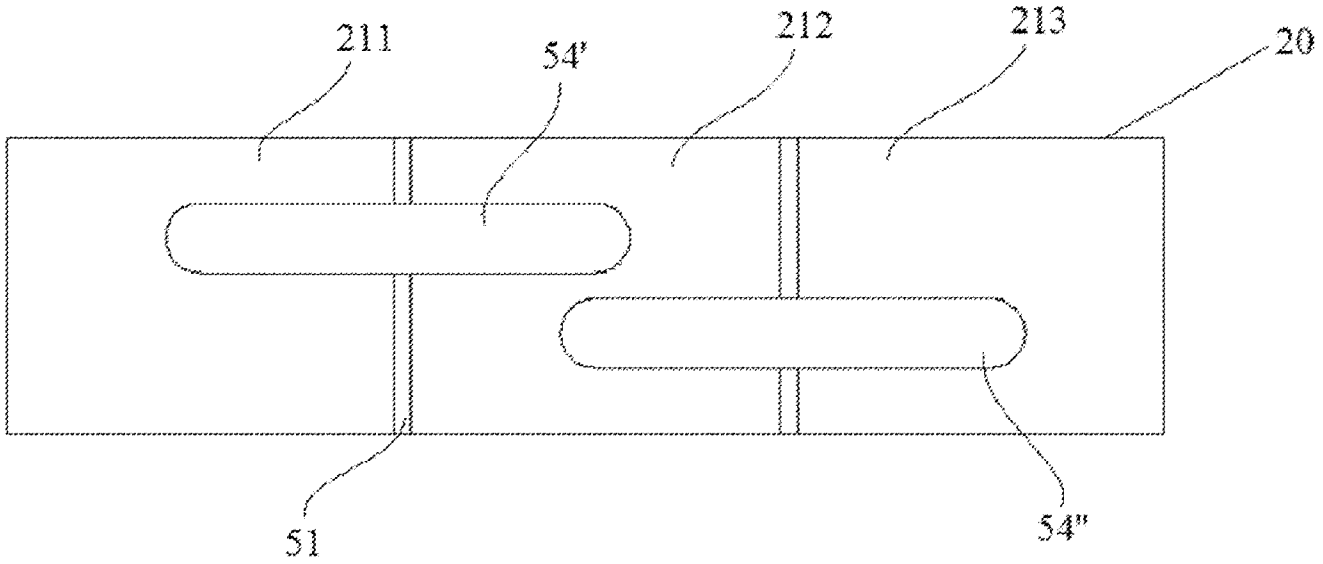
FIG. 13*b* is a top view of the disposition of jump tubes in the heat exchanger shown in FIG. 13*a*.

Referring to FIG. 13*a*, in order to obtain a further distribution effect, the two ends of each connecting tube, such as a jump tube, may be located in positions close to the middle of the two sub-cavities connected thereby, and the left and right jump tubes are positioned close to each other in the middle section cavity, or are in the same position. That is, the first jump tube 54' has one end located in a middle position of the first sub-cavity 211 of the upper cavity, and another end located in a middle position of the second sub-cavity 212. The second jump tube 54" has one end located in a middle position of the second sub-cavity 212 of the upper cavity, and another end located in a middle position of the third sub-cavity 213. Preferably, the first jump tube 54' and second jump tube 54" are connected to the second sub-cavity 212 in nearby positions, or in the same position (as shown in FIG. 13*b*). Thus, when refrigerant is distributed from the middle cavity to the two sides, since the two jump tubes are of the same size and are placed in nearly the same position, the two jump tubes can easily obtain the same flow rate of refrigerant. This ensures that the refrigerant in the two end cavities is more uniformly distributed when entering the flat tubes.

It can be understood that the above example only concerns the case where there are three sub-cavities. If a smaller or greater number of sub-cavities are provided, a person skilled in the art could set the positions of the jump tubes as required in order to connect any two sub-cavities.

Figure 14:
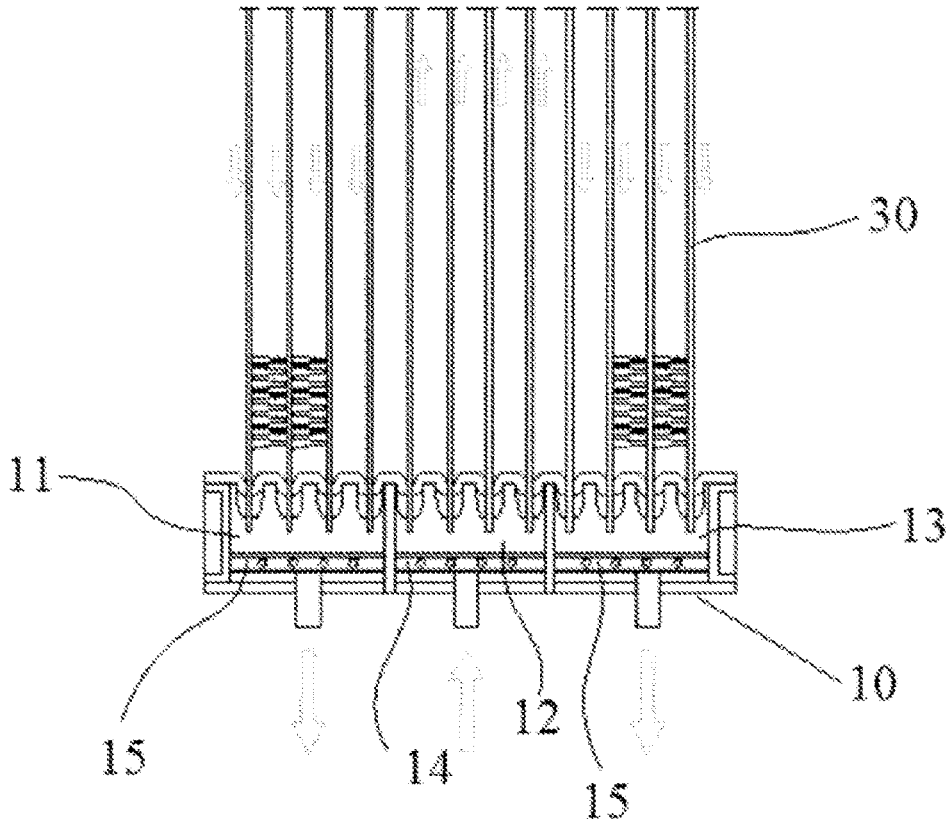
FIG. 14 is a partial view of a collecting/distributing tube and collecting tubes inserted into the inlet/outlet header of the heat exchanger shown in FIG. 12.

Preferably, a distributing tube 14 and collecting tubes 15 may also be disposed in the inlet/outlet header 10 of the heat exchanger, to obtain a better distribution effect (as shown in FIG. 14). Here, since the inlet/outlet header 10 is a single header, the distributing tube 14 and collecting tube 15 may be designed as one pipeline, but of course could also be designed as two separate components as required.

Figure 15:
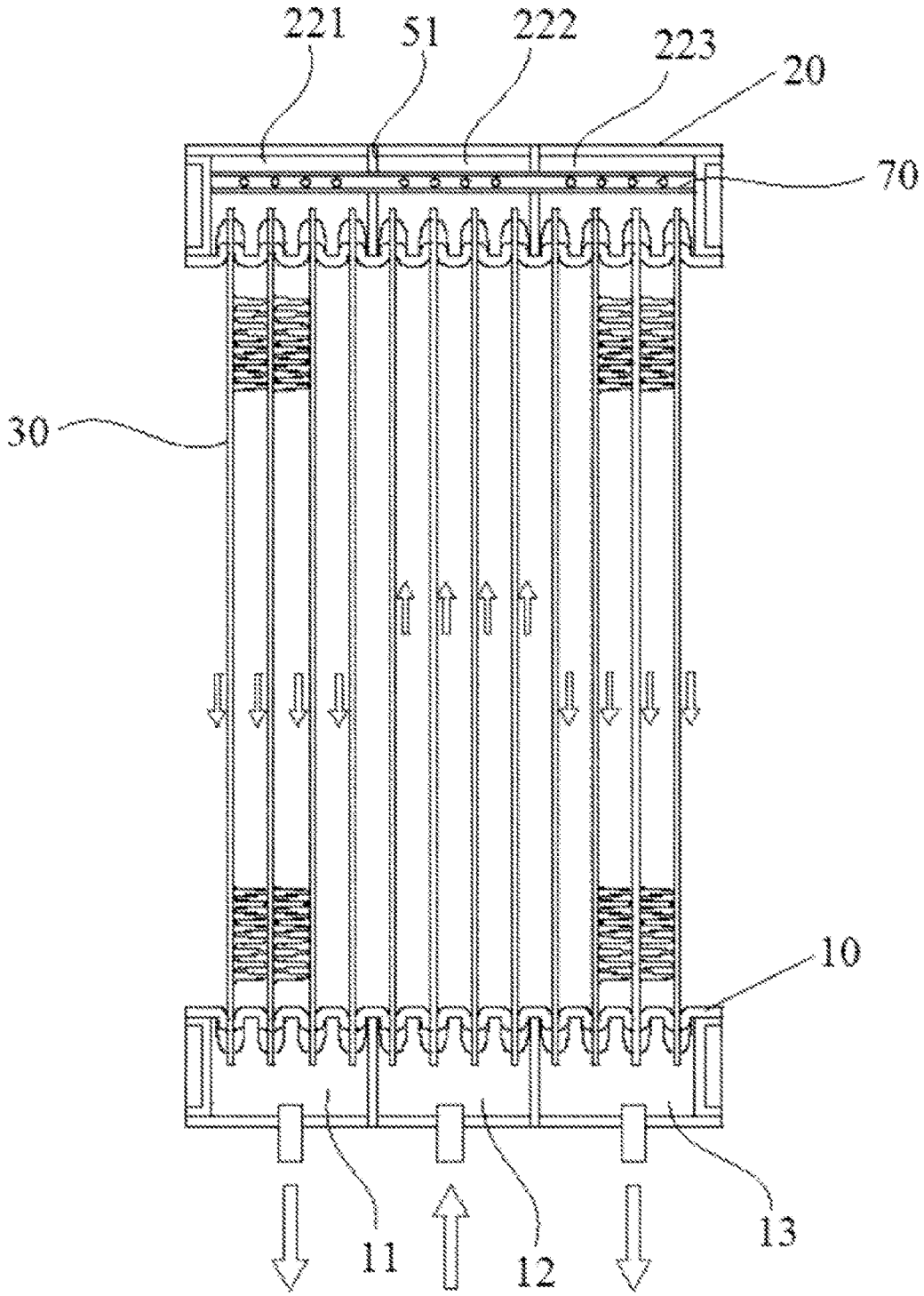
FIG. 15 is a view of a collecting/distributing tube inserted into the mixing and redistribution header of the heat exchanger according to another embodiment of the present invention.

Reference is made to FIG. 15, which shows a heat exchanger according to another embodiment of the present invention. This heat exchanger is a variation of the heat exchanger shown in FIG. 7. Thus the structure and principles of the heat exchanger shown in FIG. 15 are substantially the same as the structure and principles of the heat exchanger shown in FIG. 7, the difference being that a collecting/distributing tube 70 is inserted in the mixing and redistribution header 20. It can be understood that a better distribution effect can also be achieved in the mixing and redistribution header 20 by inserting a collecting/distributing tube 70 (as shown in FIG. 15), the collecting/distributing tube 70 being provided with multiple holes or slots in each of the abovementioned three cavities (as stated above). The differences are described in detail below; identical features will not be repeated here.

In this example, a part of a cavity of the inserted collecting/distributing tube 70 causes fluid from the inlet cavity of the heat exchanger to enter same, while the remaining part of the cavity of the inserted collecting/distributing tube 70 collects and mixes the fluid, and distributes it into a cavity of the mixing and redistribution header. The cross-sectional area of the cavity of the inserted collecting/distributing tube 70 is equal to or larger than the cross-sectional area of the remaining cavity (besides the cavity of the collecting/distributing tube) in the mixing and redistribution header.

As can be seen from FIG. 15, in order to achieve better mixing and distribution of refrigerant, the mixing and redistribution header 20 is partitioned by separating elements 51 into three mutually independent sub-cavities, i.e. a first sub-cavity 221, a second sub-cavity 222 and a third sub-cavity 223. The first sub-cavity 221 and third sub-cavity 223 are cavities at the left and right ends, while the second sub-cavity 222 is a middle cavity.

Figure 16:
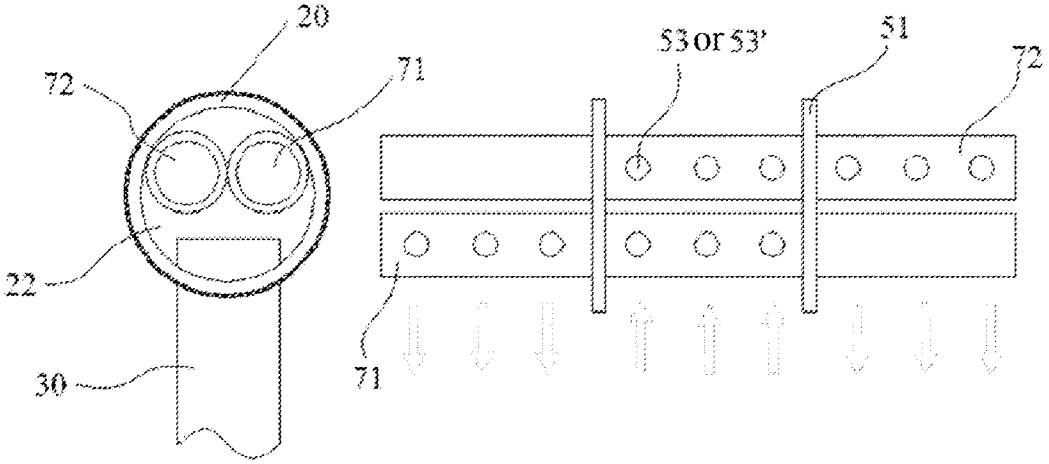
FIG. 16 is a partial view and a top view of two collecting/distributing tubes inserted into the heat exchanger shown in FIG. 15.

In order to average out the amounts of refrigerant flowing to the two end sections from the middle section of the mixing and redistribution header 20, it is also possible to insert two collecting/distributing tubes into the mixing and redistribution header 20. Referring to FIG. 16, a first collecting/distributing tube 71 (one of the collecting/distributing tubes 70) is provided with holes 53 or slots 53' in the first and second sub-cavities 221 and 222 of the mixing and redistribution header 20. A second collecting/distributing tube 72 (one of the distributing tubes) is provided with holes or slots in the second and third sub-cavities 222 and 223. The first collecting/distributing tube 71 is not provided with holes or slots in the third sub-cavity 223, i.e. is not in communication with the third sub-cavity 223. The second collecting/distributing tube 72 is not provided with holes or slots in the first sub-cavity 221, i.e. is not in communication with the first sub-cavity 221.

When a fluid (i.e. refrigerant) has flowed from the inlet cavity 12 of the inlet/outlet header 10 into the second sub-cavity 222 and has been mixed, it flows via holes 53 or slots 53' into the first and second collecting/distributing tubes 71 and 72, then is distributed into the first and third sub-cavities 221 and 223 by holes 53 or slots 53' in the corresponding collecting/distributing tubes 71 and 72 respectively, then flows into the outlet cavities 11 and 13 respectively of the inlet/outlet header 10 through the flat tubes 30, and finally flows out of the heat exchanger through the outlet tubes 11' and 13'.

Figure 17:
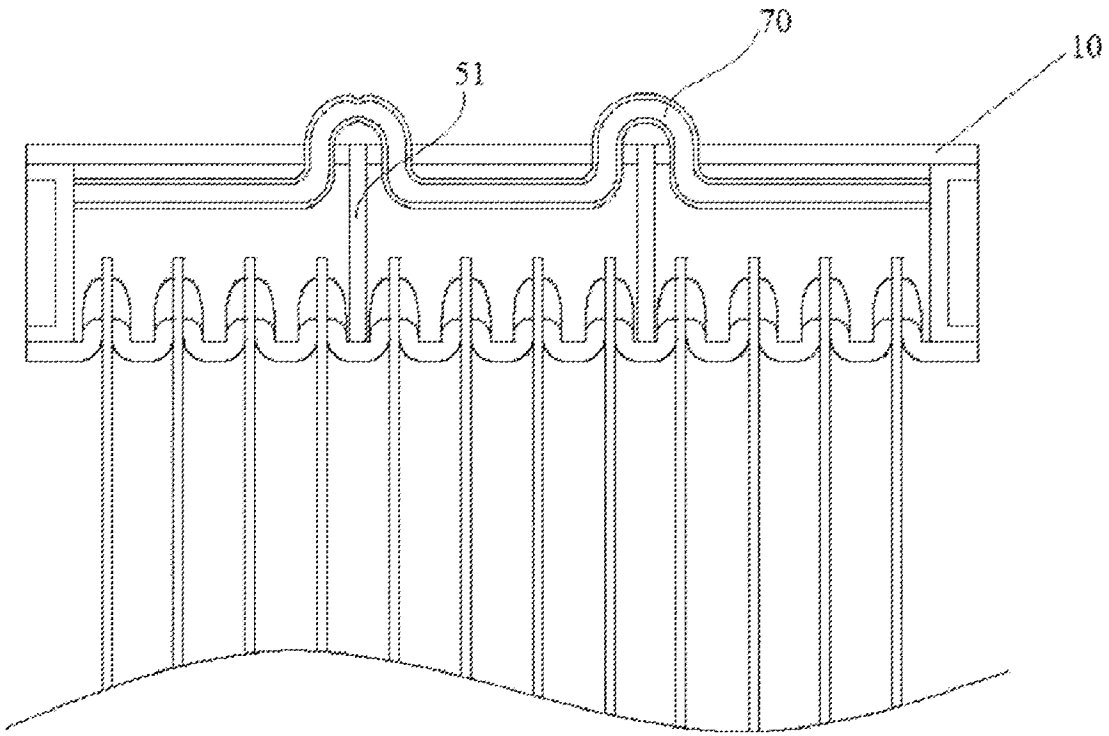
FIG. 17 is a partial view of the heat exchanger shown in FIG. 15 having a collecting/distributing tube with a reduced diameter.

The insertion of a collecting/distributing tube into the header can improve refrigerant distribution, but when distribution of refrigerant to two ends is performed in a middle section, non-uniform distribution will still occur to a greater or lesser extent. To solve the problem of balancing distribution by increasing flow resistance, the flow path of the collecting/distributing tube 70 can be artificially increased at the partition plate 51. As FIG. 17 shows, the inserted collecting/distributing tube 70 is bent at the separating elements 51 between the middle cavity and the left and right end cavities or in the middle section, so as to be located outside the mixing and redistribution header 20 and thereby have an increased flow path. On this basis, the flow of refrigerant to the left and right can also be balanced by reducing the diameter of the collecting/distributing tube 70, e.g. reducing the diameter of the collecting/distributing tube 70 at a position in the middle section.

Although two heat exchangers are used to obtain more uniform outgoing air temperature in the prior art, two heat exchangers have some drawbacks:

1. Compared with a single heat exchanger, multiple heat exchangers of the same thickness use more headers, so have a higher cost.

2. Distribution is more difficult with a wider core, and a uniform outgoing air temperature likewise cannot be obtained with non-uniform distribution.

3. There are more connecting tubes, and processing requirements are higher and complex.

4. Connecting tubes take up a certain amount of space, so the heat exchange area is affected.

5. The refrigerant flow path is longer, so flow resistance will be greater.

6. Refrigerant undergoes a phase change during heat exchange; the circulation cross section arrangement is not rational.

The present invention has the following characteristics and advantages:

1. In the case of a heat-pump-type heat exchanger, a two-loop flow path arrangement can be provided, and in the case of a shorter core arrangement, a more economical flow speed can be obtained. Two or more cavities are provided inside a two-loop middle header, and a better redistribution effect can be obtained through gravity and the positions of holes or slots.

2. On a single heat exchanger, by designing the middle as an inlet section and two ends as outlet sections, a uniform outgoing air temperature can be obtained at an air outlet of an indoor air conditioning machine, increasing the level of comfort of the air conditioning.

3. Compared with two heat exchangers, not only are the abovementioned functions realized, but also:

a) the cost is lower;

b) the product has fewer welding joints, increasing the manufacturability of the product;

c) the outgoing air temperature is more uniform.

The above are merely some embodiments of the present invention. Those skilled in the art will understand that changes may be made to these embodiments without departing from the principles and spirit of the overall inventive concept herein. The scope of the present invention is defined by the claims and their equivalents.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger, comprising:

a mixing and redistribution header at one end of the heat exchanger;

multiple heat exchange tubes in communication with the mixing and redistribution header;

wherein an upper cavity and a lower cavity in communication with each other are disposed in the mixing and redistribution header; a fluid entering the heat exchanger first flows into a part of the lower cavity of the mixing and redistribution header, then is collected and mixed in the upper cavity of the mixing and redistribution header, and is distributed into another part of the lower cavity and flows out through a heat exchange tube of the multiple heat exchange tubes in communication with the lower cavity, a cross-sectional area of the upper cavity being equal to or greater than a cross-sectional area of the lower cavity;

wherein the upper cavity and lower cavity are separated by a partition plate;

wherein the upper cavity is partitioned into at least three sub-cavities by separating elements;

wherein the at least three sub-cavities comprises a first sub-cavity, a second sub-cavity and a third sub-cavity;

wherein the second sub-cavity is centrally located between the first sub-cavity and the third sub-cavity;

wherein the second sub-cavity is in communication with the first sub-cavity via a first jump tube; and wherein the second sub-cavity is in communication with the third sub-cavity via a second jump tube.

2. The heat exchanger as claimed in claim 1, wherein the first jump tube has one end located in a middle position of the first sub-cavity and another end located in a middle position of the second sub-cavity; and wherein a second jump tube has one end located in a middle position of the third sub-cavity and another end located in a middle position of the second sub-cavity, wherein the first jump tube and second jump tube are connected to the second sub-cavity in adjacent positions, or the first jump tube and the second tube are aligned at least partially in a width direction of the mixing and redistribution header.

3. The heat exchanger as claimed in claim 1, wherein wall surfaces between the upper cavity and lower cavity are in communication via holes and/or slots, the lower cavity being partitioned into at least three sub-cavities.

4. The heat exchanger as claimed in claim 3, wherein the sub-cavities of the upper cavity being in corresponding communication with the sub-cavities of the lower cavity.

5. The heat exchanger as claimed in claim 4, wherein a middle section on a wall surface between the upper cavity and lower cavity is in corresponding communication with an inlet cavity of the heat exchanger, two end sections thereof are in corresponding communication with outlet cavities of the heat exchanger respectively, and the wall surface at the two end sections is provided with holes or slots of a size smaller than those in the wall surface at the middle section.

6. The heat exchanger as claimed in claim 5, wherein the sums of the cross-sectional areas of the holes and/or slots provided in a left end section of the two end sections, the middle section and a right end section of the two end sections are S1, S2 and S3 respectively, the lengths of these in a direction perpendicular to the longitudinal direction of the heat exchange tubes are set to be L1, L2 and L3 respectively, and at least one of the following conditions is satisfied:

$$0.8 \le L2/((L1+L3)/2) \le 1.2,$$

$$0.8 \le L1/L3 \le 1.2$$

S2 is 1-2 times as large as S1 or S3;

$$0.9 \le (S1/S3)/(L1/L3) \le 1.1.$$

7. The heat exchanger as claimed in claim 1, wherein the heat exchanger also comprises an inlet header and an outlet header, or an inlet/outlet header, which is/are in communication with the mixing and redistribution header via heat exchange tubes, the heat exchange tubes being flat tubes.

8. The heat exchanger as claimed in claim 7, wherein a distributing tube is disposed in an inlet cavity in the inlet header or inlet/outlet header, and a collecting tube is disposed in an outlet cavity in the outlet header or inlet/outlet header.

9. The heat exchanger as claimed in claim 8, wherein the upper cavity and lower cavity are a single-piece structure or a combined structure, wherein the ratio of the numbers of the heat exchange tubes connected to the inlet cavity and outlet cavity is in the range 0.8-1.2, and the heat exchange tubes are flat tubes.

10. The heat exchanger as claimed in claim 1, wherein wall surfaces between the upper cavity and lower cavity are in communication via holes and/or slots, the lower cavity being partitioned into at least three sub-cavities.

11. The heat exchanger as claimed in claim 2, wherein wall surfaces between the upper cavity and lower cavity are in communication via holes and/or slots, the lower cavity being partitioned into at least three sub-cavities.

12. The heat exchanger as claimed in claim 1, wherein each end of each jump tube is arranged in a respective sub-cavity of the at least three sub-cavities.

* * * * *